United States Patent [19]

Baldwin et al.

[11] 4,137,583

[45] Feb. 6, 1979

[54] GYMNASTIC MAT

[75] Inventors: Beecher B. Baldwin, Los Angeles; Harold Higgins, San Diego, both of Calif.

[73] Assignee: Baldwin/Green Inc., El Cajon, Calif.

[21] Appl. No.: 858,652

[22] Filed: Dec. 8, 1977

Related U.S. Application Data

[63] Continuation of Ser. No. 728,221, Sep. 30, 1976, abandoned.

[51] Int. Cl.[2] ..... A47G 9/00

[52] U.S. Cl. ..... 5/344; 272/109

[58] Field of Search ..... 5/344, 345; 24/119, 24/122-126, 128 B, 128 K, 130, 203, 230, 265 R, 265 U, 265 CD; 248/500; 272/65, 101, 109; 273/1 A; 280/179 R, 179 A; 296/100

[56] References Cited

U.S. PATENT DOCUMENTS

| | | | |
|---|---|---|---|
| 3,120,042 | 2/1964 | Speranza et al. | 24/123 |
| 3,284,819 | 11/1966 | Nissen | 5/344 |
| 3,480,241 | 11/1969 | Moyer | 248/499 |
| 3,518,707 | 7/1970 | Nissen | 5/344 |
| 3,892,401 | 7/1975 | Sorenson | 5/344 |
| 3,893,198 | 7/1975 | Blair | 5/345 R |

*Primary Examiner*—Peter M. Caun

*Attorney, Agent, or Firm*—Harris, Kern, Wallen & Tinsley

[57] ABSTRACT

A gymnastic mat capable of simple assembly and disassembly for compact storage. Cushioning material is contained within a readily disassemblable rigid frame. A cover of flexible material is attached to the top of the frame by elastic tie-down devices to contain the cushioning material within the frame and maintain a taut and wrinkle-free surface.

4 Claims, 6 Drawing Figures

GYMNASTIC MAT

This is a continuation of application Ser. No. 728,221, filed Sept. 30, 1976, abandoned.

BACKGROUND OF THE INVENTION

1. Field of the Invention

The present invention relates to gymnastics mats and the like such as those employed for free excercise, wrestling, judo, etc. In particular, it relates to gymnastics mats which may be conveniently disassembled and stored regardless of their dimensions during use.

2. Description of the Prior Art

The use of cushioning is a necessity for the safe conduct of certain athletic activities. In particular, those activities performed indoors on a hard surface mandate mat type equipment. Free exercise, wrestling and judo are examples of such activities. Like most athletic endeavors, they are not confined to a small or well defined area but require a rather large available surface for the participant(s) to utilize. Presently it is common to array a mat or series of mats, each consisting of cushioning material contained within an outer covering. The area to be covered may be in the order of 24 feet × 24 feet or 44 feet by 44 feet. Generally, one or a plurality of mats is utilized in such an athletic activity. A problem arises when such a cushioning arrangement is provided due to the fact that a single large mat utilized to cover a large surface may be intolerably heavy and bulky. This often necessitates the more or less permanent storage of the mat within the activity room or area in its rolled-up state. The use of a series of smaller mats may allow the removal of the floor covering in sections. However, in use, multiple mats may create a hazard for the athlete. Such mats may slide to expose the hard surface. Alternatively, it is difficult to achieve full surface coverage without "bumps" due to the overlap of adjoining mat sections near the intersection of a pair of mats. Such bumps may be as harmful to the user of the mat as an exposed hard surface. They will exert a large reaction force when two wrestlers, for instance, fall or may present a tripping hazard.

SUMMARY OF THE INVENTION

The present invention essentially comprises an adjustable frame containing cushioning material. The cushioning material is retained within the frame by a flexible cover. A plurality of notches located on the exterior of the frame matches a plurality of elastic cords at the perimeter of the cover to provide an easily assemblable and disassemblable unit. The elastic fasteners exert an inward force on the frame and keep the cover taut over the cushioning material, resulting in a smooth surface. The cushioning material or pad may be composed of any number of individual pieces.

OBJECTS OF THE INVENTION

An object of the present invention is to provide a gymnastics mat, capable of covering a large surface area, which may be simply and conveniently disassembled and stored in a relatively small area.

Another object of this invention is to provide a gymnastics mat which is of adjustable size.

Still another object of this invention is to provide a gymnastics mat which remains wrinkle-free regardless of the effects of the weather on its cushioning material.

Other objects, advantages and features of the present invention will be readily apparent from the following detailed description wherein like numerals represent like features throughout.

DESCRIPTION OF THE PREFERRED EMBODIMENT

Figure 1:
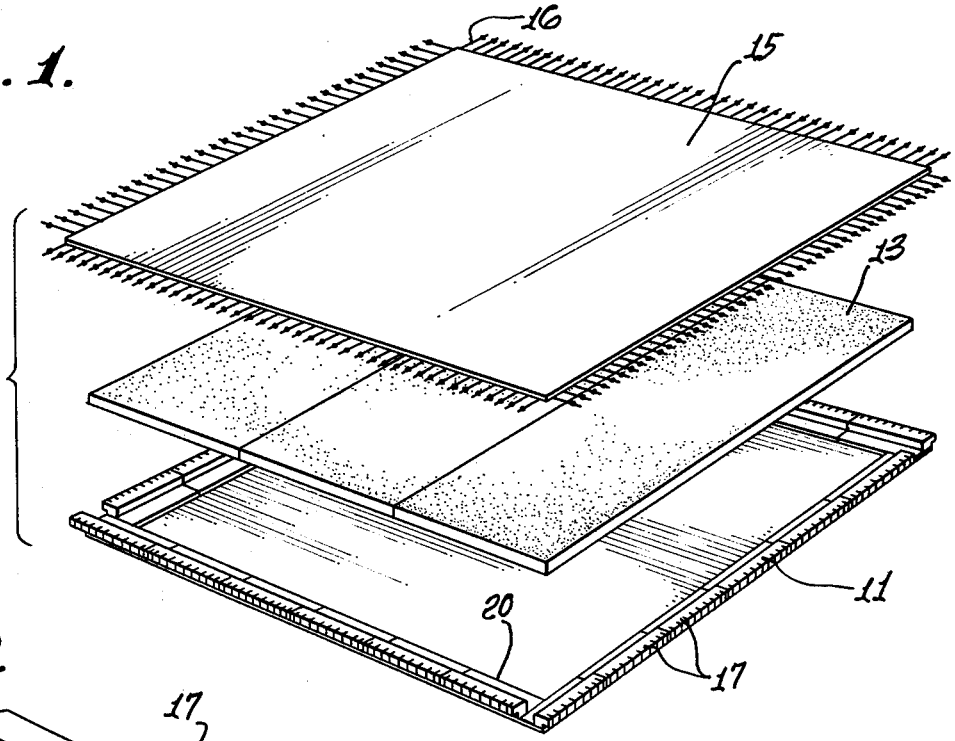
FIG. 1 is an exploded perspective view of a mat incorporating the presently preferred embodiment of the invention.
Figure 2:
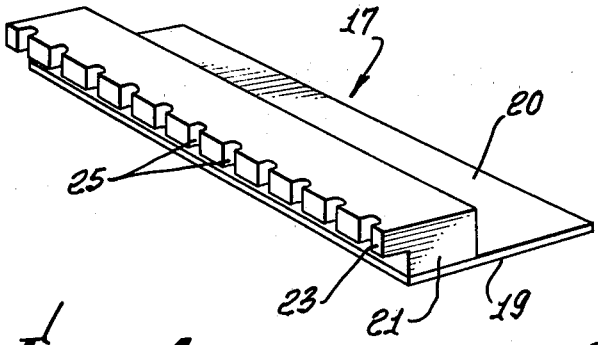
FIG. 2 is a perspective view of a frame segment of the mat of FIG. 1.

The gymnastics mat of FIG. 1 consists of an adjustable frame 11, cushioning material or pad 13 which may be mounted therein, and a cover 15. The cover 15 is adapted to be attached to the frame 11 by a plurality of tie-down devices 16 located at its perimeter.

In the preferred embodiment illustrated the frame 11 is formed of a plurality of segments 17 and may be adjusted in size by the addition or removal of one or more segments. For gymnastics use 24 feet × 24 feet and 44 feet × 44 feet are useful primary sizes. Each segment 17 may comprise a base portion 19 with inwardly projecting flange 20 adjoined to a block portion 21 with outwardly projecting flange 23. When the segments 17 are positioned side-by-side, the flanges 20 form a thin web extending into the interior of the frame 11 under the pad 13. As will be discussed below, the cross-sectional geometry of segments 17 achieves stability by providing a torque which counteracts that generated by forces exerted by and through the tie-down devices 16 on the block portion 21. The exterior flanges 23 have a plurality of notches 25 providing points of attachment for the tie-down devices 16.

Figure 3:
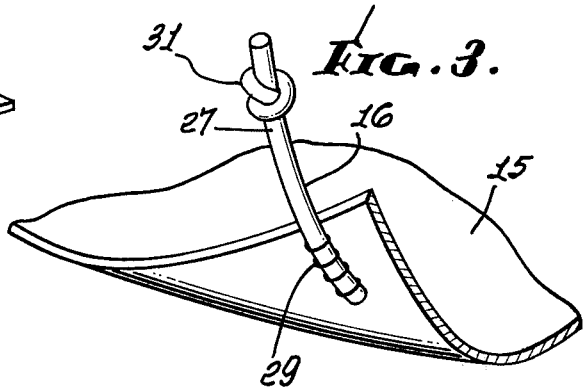
FIG. 3 is an enlarged view of one of the tie-down devices of the mat of FIG. 1.
Figure 6:
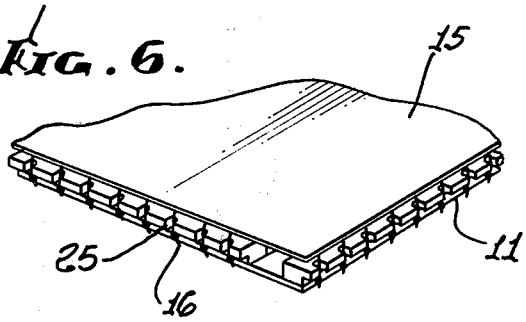
FIG. 6 is a fragmentary view showing the mat of FIG. 1 assembled for use.

A preferred form of tie-down device 16 to engage cover 15 to frame 11 is illustrated in FIG. 3. The device consists of a strap 27 attached, as by thread or wire 29, to the cover 15. A knot 31 is formed in the strap 27 to engage the appropriate notch 25 of frame 11 below flange 23. The strap 27 is preferably formed of elastomeric material, such as shock cord. When fully assembled as shown in FIG. 6 each tie-down device 16 is each fitted into a corresponding notch 25.

The frame 11 can be constructed of any rigid material. If frame 11 is of the adjustable (or segmented) type it may be easily assembled by laying the desired number of segments 17 end to end. Each segment 17 preferably is of identical construction, requiring an overlap of intersecting base portions 19 at the corners of the frame 11. The relatively thin construction of the base portions 19 allows such overlap, affording economy of manufacture use and repair.

Once the frame has been laid out, its interior may be filled with cushioning material 13. The cushioning material may be any protective padding and may consist of any number of segments which, when laid together, fill the interior of frame 11. Two commonly employed materials especially suitable for this application are Ethafoam, a closed cell foam, and Rubatex, a high density rubber product. Both are especially appropriate for gym mat applications.

Figure 4:
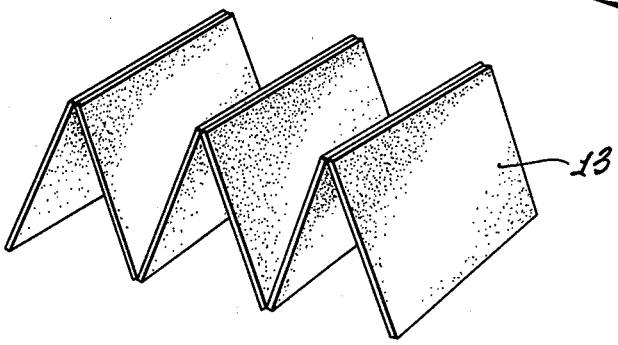
FIG. 4 shows a foldable type of cushioning pad which may be utilized in the mat of FIG. 1.
Figure 5:
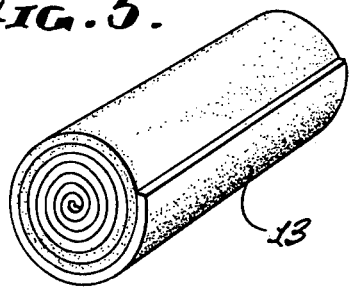
FIG. 5 illustrates a rollable type of cushioning pad which may be utilized in the mat of FIG. 1.

The cushioning materials or pads 13 may be stored separate and apart from frame segments 17 and cover 15 after use, for instance, by sectional folding as shown in FIG. 4 or by rolling the material as shown in FIG. 5. The cusioning material 13 which is shown in FIG. 1 as comprising three segments may consist of any of a number of pieces. The proper configuration for any use may be selected in light of the storage area available to the user. A large number of blocks may be advantageous, thus requiring no rolling or folding. The fatiguing of the cushioning material 13 will thus be minimized. A major feature of the present invention is that the same smooth surface for the athletic event may be achieved with the present invention regardless of the configuration of the cushioning material 13. Also, the cushioning material 13 may be replaced after prolonged use by simply unfastening the tie-down members 16 from the notches 25 and replacing those sections of cushioning material which have been damaged. Additionally, the cushioning material 13 need only be covered on one side by the cover 15, affording a 50% savings in covering material over conventional gymnastic mats, with an attendant saving of labor and other manufacturing costs. By the removal of one or more segments 17 of the frame 11 and the use of a corresponding alternatively sized cover 15, a different sized mat may be constructed for different uses and surface areas. Cover 15 in conjunction with the elasticity of tie-down devices 16 will cause the cushioning material 13 to be maintained as one non-wrinkled flat surface to the user. The frame 11, in conjunction with cover 15, will assure that the pieces of cushioning material 13 remain correctly positioned during use.

The cover 15 may be of any flexible, durable fabric. Vinyl coated nylon material is an example of a material suitable for most applications. The elastic-type tie-down devices 16 spaced at the perimeter of cover 15 and anchored by means of knots 29 to frame notches 25 assure that the top cover 15 will remain taut and will impart an inward acting force on the frame 11. Such force serves to further compress the pieces of cushioning material 13 together. This is of some importance when a cushioning material 13 is employed which expands or contracts in response to temperature variation. The segmented construction of frame 11 allows it to cooperate with this inward, self-correcting force. The force exerted on the flange 23 of frame 11 has a tendency to generate a torque which tends to lift the outer edge of the frame 11 off the ground. This tendency is counter-acted by torque generated by the reaction force of the ground against the inwardly extending base portion 19 of the frame segments 17. The frame segements 17 are stabilized thereby and will not overturn.

Thus, it is seen that there has been achieved a renewable gymnastics mat of simple construction which may be quickly and simply assembled, disassembled or adjusted in size for storage in a comparatively small area.

I claim:

1. A gymnastic mat including in combination:

a frame having a peripheral rim comprising a plurality of separate rigid segments positioned side-by-side to provide an open interior;

a pad of cushioning material within the interior of said frame, said pad of material substantially filling the interior of said frame;

each of said segments has an upper portion and a lower portion, with said lower portion extending under said pad into said interior of said frame beyond said upper portion;

a cover of flexible material and having a top surface; and a plurality of resilient connectors fixed to said cover along the edges thereof and below said top surface, with said connectors and frame segments having interengaging means attaching said cover to said frame with said resilient connectors stretched and maintaining said cover in tension with a smooth top surface, said cover and connectors imparting an inward acting force on said frame, said inward acting force serving to compress said pad of cushioning material, said pad of cushioning material imparting an equal and opposite outward acting force on said frame and cover.

2. A mat as defined in claim 1 wherein said resilient connectors comprise elastic cords fixed at one end to the underside of said cover and having an enlarged portion at the other end for engaging a notch in said frame.

3. A mat as defined in cliam 1 wherein:

each of said segments of said frame has a plurality of notches in the upper portion thereof; and said resilient connectors comprise elastic cords fixed at one end to said cover below said top surface thereof and having a knot at the other end, with said cords positioned in corresponding notches stretching said cords and placing said cover in tension.

4. A mat as defined in claim 1 wherein said pad of cushioning material further comprises a plurality of pad elements.

* * * * *